US010094619B2

(12) United States Patent
Holiday

(10) Patent No.: US 10,094,619 B2
(45) Date of Patent: Oct. 9, 2018

(54) HEAT EXCHANGER HAVING ARCUATELY AND LINEARLY ARRANGED HEAT EXCHANGE TUBES

(71) Applicant: LAARS HEATING SYSTEMS COMPANY, Rochester, NH (US)

(72) Inventor: Christopher J. Holiday, Alton Bay, NH (US)

(73) Assignee: LAARS HEATING SYSTEMS COMPANY, Rochester, NH (US)

( * ) Notice: Subject to any disclaimer, the term of this patent is extended or adjusted under 35 U.S.C. 154(b) by 0 days.

(21) Appl. No.: 14/904,471

(22) PCT Filed: Jul. 11, 2014

(86) PCT No.: PCT/US2014/046326

§ 371 (c)(1),
(2) Date: Jan. 12, 2016

(87) PCT Pub. No.: WO2015/006677

PCT Pub. Date: Jan. 15, 2015

(65) Prior Publication Data

US 2016/0195337 A1 Jul. 7, 2016

Related U.S. Application Data

(60) Provisional application No. 61/845,634, filed on Jul. 12, 2013.

(51) Int. Cl.
*F28D 7/00* (2006.01)
*F28D 7/16* (2006.01)
(Continued)

(52) U.S. Cl.
CPC ..... *F28D 7/1646* (2013.01); *F24H 1/0027* (2013.01); *F24H 1/403* (2013.01);
(Continued)

(58) Field of Classification Search
CPC .... F28D 1/1646; F28D 7/1653; F28D 7/1669; F28D 21/0003; F28D 21/0007;
(Continued)

(56) References Cited

U.S. PATENT DOCUMENTS 1,708,229 A 4/1929 McClellon
1,948,550 A 2/1934 Voorheis
(Continued)

FOREIGN PATENT DOCUMENTS

CA 1154336 A 9/1983
EP 0037333 A1 10/1981
(Continued)

OTHER PUBLICATIONS

International Preliminary Report on Patentability and Written Opinion for International Application No. PCT/US2014/046326 dated Jan. 12, 2016.
(Continued)

*Primary Examiner* — Davis Hwu
(74) *Attorney, Agent, or Firm* — RatnerPrestia

(57) ABSTRACT

Disclosed is a heat exchanger that has an internal air flow pattern such as a helical pattern. The heat exchanger includes a shell that encompasses an inner series of heat exchange tubes and an outer series of heat exchange tubes. A baffle sheet is juxtaposed next to the outer series of heat exchange tubes. And the baffle sheet is configured to direct air flow within the heat exchanger in a configuration, such as a helical configuration, from a center of the shell toward an outer region of the shell.

26 Claims, 9 Drawing Sheets

(51) Int. Cl.

| | |
|---|---|
| ***F28F 9/22*** | (2006.01) |
| ***F28D 21/00*** | (2006.01) |
| ***F28F 1/20*** | (2006.01) |
| ***F24H 1/40*** | (2006.01) |
| ***F24H 9/00*** | (2006.01) |
| ***F24H 1/00*** | (2006.01) |

(52) U.S. Cl.
CPC ..... *F24H 9/0005* (2013.01); *F24H 9/0026* (2013.01); *F28D 7/1653* (2013.01); *F28D 7/1669* (2013.01); *F28D 21/0003* (2013.01); *F28D 21/0007* (2013.01); *F28F 1/20* (2013.01); *F28F 9/22* (2013.01); *F24D 2220/06* (2013.01); *F28D 2021/0096* (2013.01); *F28F 2009/224* (2013.01)

(58) Field of Classification Search
CPC ..... F24H 1/0027; F24H 1/403; F24H 9/0005; F24H 9/0026; F28F 1/20; F28F 9/22
USPC ..... 165/161, 104.12
See application file for complete search history.

(56) References Cited

U.S. PATENT DOCUMENTS

| | | | | |
|---|---|---|---|---|
| 2,622,853 | A * | 12/1952 | Becker | B01J 8/0005 122/131 |
| 3,616,849 | A | 11/1971 | Dijt | |
| 4,055,125 | A | 10/1977 | Mallek | |
| 4,055,152 | A | 10/1977 | Vidalenq | |
| 4,079,702 | A | 3/1978 | Furukawa et al. | |
| 4,093,022 | A | 6/1978 | Polyak et al. | |
| 4,175,308 | A | 11/1979 | Togashi et al. | |
| 4,401,058 | A | 8/1983 | Charrier et al. | |
| 4,660,632 | A | 4/1987 | Yampolsky et al. | |
| 5,150,520 | A | 9/1992 | DeRisi | |
| 5,163,408 | A | 11/1992 | Nemoto | |
| 5,503,222 | A * | 4/1996 | Dunne | B01J 20/183 165/10 |
| 5,638,898 | A | 6/1997 | Gu | |
| 2011/0094720 | A1 | 4/2011 | Wang | |
| 2011/0203781 | A1 | 8/2011 | Ellingwood et al. | |
| 2012/0192812 | A1 | 8/2012 | Rahmani | |
| 2014/0373798 | A1 | 12/2014 | Alfano et al. | |

FOREIGN PATENT DOCUMENTS

| | | |
|---|---|---|
| EP | 0459785 | 7/1994 |
| EP | 1050721 A1 | 11/2000 |
| FR | 1367549 A | 7/1964 |

OTHER PUBLICATIONS

International Search Report for International Application No. PCT/US2014/046326, dated Nov. 14, 2014.
Written Opinion of the International Searching Authority for International Application No. PCT/US2014/046326, dated Nov. 14, 2014.
European Search Report for European Application No. 14 742 909.6, dated Nov. 9, 2016—10 pages.
European Communication for European Application No. 14 742 909.6, dated Nov. 22, 2017—4 pages.
International Preliminary Report on Patentability for International Application No. PCT/US2014/012706, dated Aug. 6, 2015—7 Pages.
Supplementary Partial European Search Report for European Application No. 14 742 909.6, dated Aug. 3, 2016—6 pages.
Non Final Office Action for Application No. 14/762,952, dated Aug. 21, 2017, 27 pages.
Final Office Action for U.S. Appl. No. 14/762,952, dated Mar. 16, 2018, 16 pages.

* cited by examiner

HEAT EXCHANGER HAVING ARCUATELY AND LINEARLY ARRANGED HEAT EXCHANGE TUBES

CROSS-REFERENCE TO RELATED APPLICATIONS

This application is a U.S. National Phase Patent Application of PCT Patent Application No. PCT/US2014/046326, filed Jul. 11, 2014, which claims priority to U.S. Provisional Patent Application No. 61/845,634, filed Jul. 12, 2013, both of which are incorporated by reference herein in their entirety.

FIELD OF THE INVENTION

The present inventive subject matter generally relates to heat exchanging devices including heat exchanging tubes.

BACKGROUND OF THE INVENTION

Heat exchangers are devices for transferring heat from one medium to another, typically from one fluid to another or to a surrounding environment, without allowing the fluids to mix. Some examples are: automobile radiators; air conditioners, and steam hot water radiators, and water boilers and heating systems, which are used to produce or remove heat. In order to prevent mixing of the fluids, or liquids, a barrier is provided between the two liquids or media. Many different heat exchanger barrier designs are used. In a "plate and frame" design, which is very compact, two liquid streams pass on opposing sides of one or more plates. The total heat transfer surface may be increased by increasing the area of plates and the number of plates. In a "tube and shell" design, one stream of liquid flow passes through tube(s) and the other through the remaining space inside a shell that surrounds the tubes.

Though improvements to such heat exchangers have been made over the years, there remains a need for further improvements that increase efficiency, improve performance, reduce cost, and/or reduce the size of heat exchangers.

SUMMARY

A heat exchanger with a plurality of baffles for directing air flow in a helical configuration is disclosed. An embodiment of the heat exchanger includes a shell that encompasses an inner series of heat exchange tubes and an outer series of heat exchange tubes. A baffle sheet is juxtaposed next to the outer series of heat exchange tubes. And the baffle sheet, in cooperation with a neighboring baffle sheet, directs air flow within the heat exchanger in a helical configuration from a center of the shell toward an outer region of the shell.

A further embodiment of the heat exchanger is one in which baffles are positioned relative to an outer ring of tubes such that the air flow velocity speeds up as air reaches the outer portion of the heat exchanger. This embodiment includes a set of baffles that surround a plurality of heat exchange tubes. The baffles and heat exchange tubes are encompassed by a shell. An airflow passageway is between the set of baffles and the plurality of heat exchange tubes. And the airflow velocity at an upstream portion of the airflow passageway is lower than airflow velocity at a downstream portion of the airflow passageway.

A further embodiment of the heat exchanger is one in which the baffles are rectilinear as opposed to arcuate or any other configuration. In this embodiment, the heat exchanger includes a heat exchanger shell in a curved or rectilinear configuration. Upper and lower manifolds are at opposing ends of the heat exchanger shell. A first tube set is arcuately arranged around a hot gas burner at or near the center of the heat exchanger. And a second tube set is linearly arranged and is proximate to the arcuate arrangement of tubes.

DETAILED DESCRIPTION OF THE EMBODIMENTS

Figure 1:
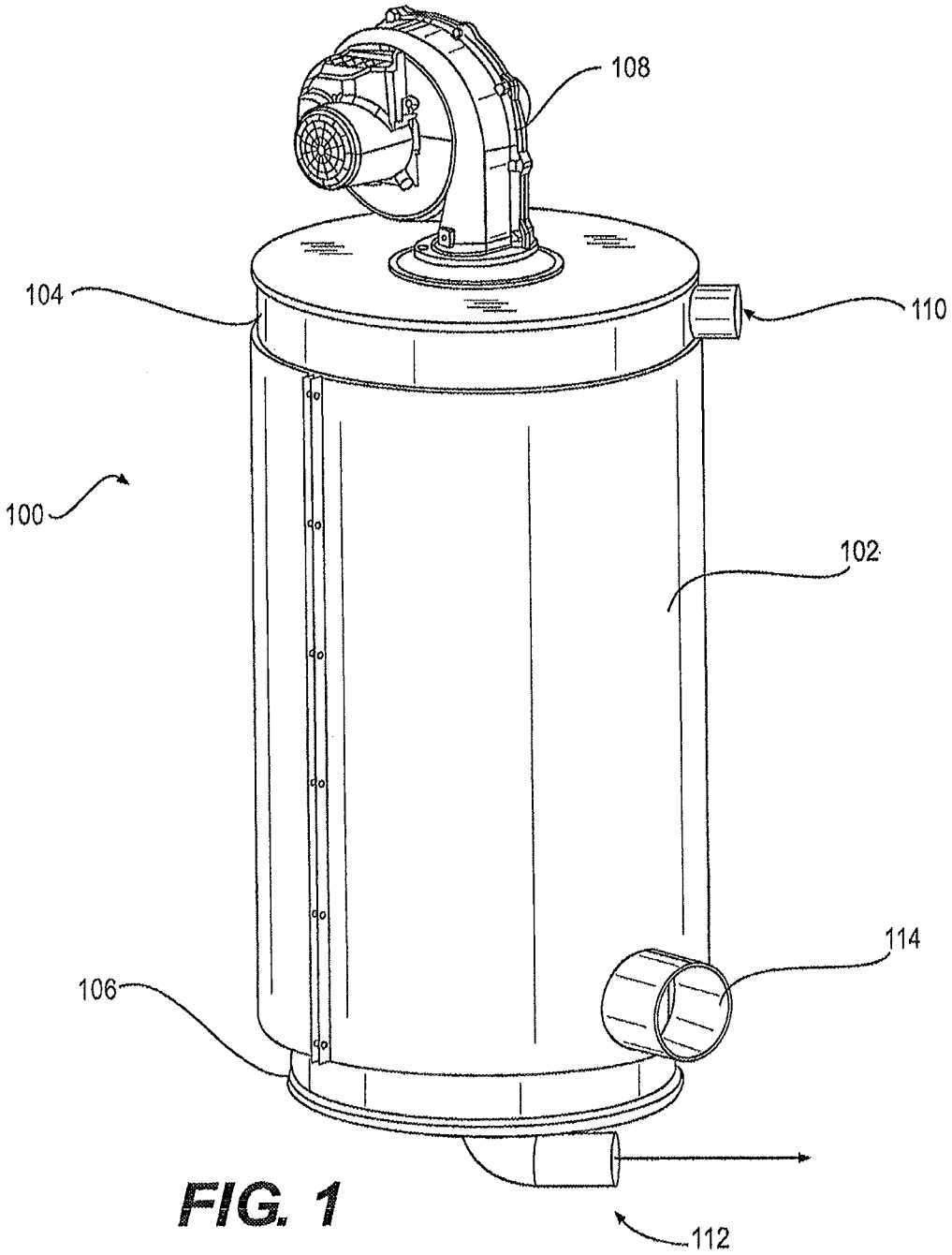
FIG. 1 shows an embodiment of the disclosed heat exchanger.

A heat exchanger 100 with a plurality of baffles for directing air flow in a helical configuration is disclosed. An embodiment of the heat exchanger includes a shell 102 that encompasses an inner series of heat exchange tubes 212 and an outer series of heat exchange tubes 202. A baffle sheet 404 is juxtaposed next to the outer series of heat exchange tubes 202. And the baffle sheet 404, in cooperation with a neighboring baffle sheet, directs air flow within the heat exchanger 100 in a helical configuration from a center of the shell toward an outer region of the shell.

A further embodiment of the heat exchanger is one in which baffles are positioned relative to an outer ring of tubes such that the air flow velocity speeds up as air reaches the outer portion of the heat exchanger. This embodiment includes a set of baffles that surround a plurality of heat exchange tubes. The baffles and heat exchange tubes are encompassed by a shell. An airflow passageway 414 is between the set of baffles and the plurality of heat exchange tubes. And the airflow velocity at an upstream portion 410 of the airflow passageway is lower than airflow velocity at a downstream portion 412 of the airflow passageway 414.

A further embodiment of the heat exchanger is one in which the baffles are rectilinear as opposed to arcuate or any other configuration. In this embodiment, the heat exchanger includes a heat exchanger shell in a curved or rectilinear configuration. Upper and lower manifolds 104 and 106 are at opposing ends of the heat exchanger shell 102. A first tube set is arcuately arranged around a hot gas burner at or near the center of the heat exchanger. And a second tube set is linearly arranged and is proximate to the arcuate arrangement of tubes.

An embodiment of the inventive heat exchanger 100 is shown in FIG. 1. The heat exchanger 100 includes a shell 102, an upper manifold 104, a lower manifold 106 and a blower motor 108. The upper manifold 104 includes an intake 110 for cold water access to the heat exchanger 100 and the lower manifold 106 includes an outlet 112 for allowing heated water to exit the heat exchanger. An air side outlet 114 is provided at a lower end of the shell 102 to allow the discharge of combustion gas and condensate. An air side inlet (not shown) is provided at the upper end of the heat exchanger 100 via the blower motor 108. The air side inlet mixes combustion gas and air. The air side outlet is shown in FIG. 1 as a single port. However, the combustion gas outlet and the condensate outlet are not so limited and can be separate ports.

Figure 2:
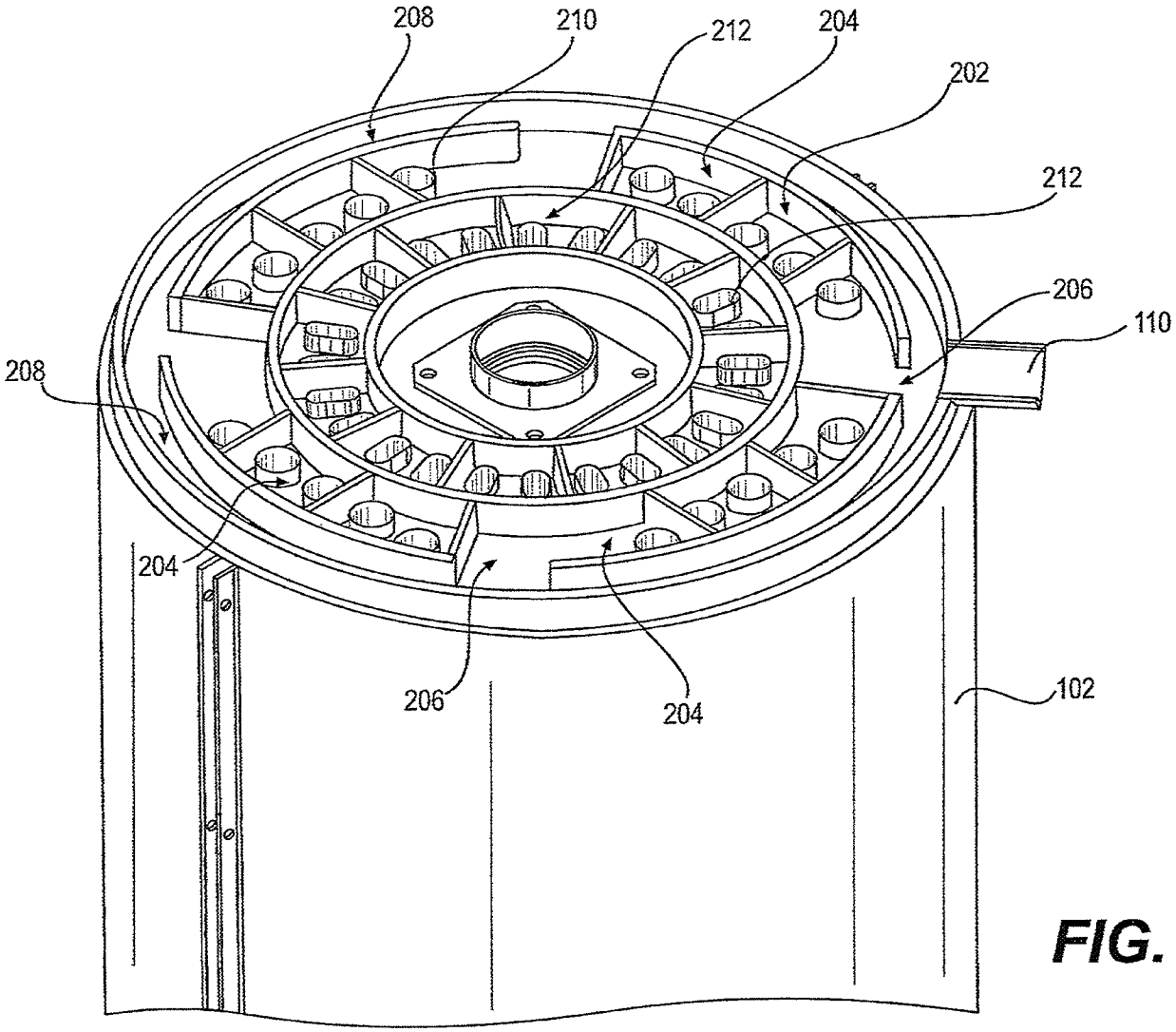
FIG. 2 shows a perspective view of an upper manifold on one end of the disclosed heat exchanger of FIG. 1.

FIG. 2 shows the upper manifold 104. The intake 110 introduces cold water into the system. An outer ring of tubes 202 that receives water directly from the intake 110 is in direct contact with the intake 110. The outer ring of tubes is broken down into tube sets. The ends of each tube of the outer ring of tubes 202 empties into a manifold compartment 204.

Each tube set has a manifold compartment opening 206 that is in direct contact with a circumferential ring 208. The circumferential ring 208 is positioned along the circumference of the upper manifold 104. The circumferential ring 208 allows water entering the heat exchanger to be distributed to each tube set at a substantially even temperature and flow rate. The outer ring of tubes 202 can be arranged perpendicular to each other in a linear row or they can be arranged in an arcuate row. A linear row makes the entire heat exchanger easier to assemble; however, neither configuration is preferable over the other. A linear row also makes the baffle a symmetrical part, minimizing SKUs and providing better manufacturability.

In the present heat exchanger, water flow and air flow are in a counter flow configuration to maximize heat transfer. This is achieved by the passageways in the water manifold so that the coldest water temperature (inlet) passes through the coldest combustion gas temps (air side outlet). Water enters the manifold compartment through the manifold compartment opening 206 and enters any tube or tubes that are in fluid communication with the manifold compartment opening 206 (for example, tube 210 in FIG. 2). Water flows into the tube set for multiple passes, being redirected for each additional pass at the manifold compartment 204. When water reaches the last tube in the tube set, the water is directed toward an inner ring of tubes 212. The tubes can be MIG or TIG welded to the manifold. And they can also be brazed to the manifold or connected by any other equivalent technique known in the art.

As combustion gas passes the inner ring of tubes 212, it flows radially outward. This radial flow of the combustion gas provides the inner ring of tubes 212 enough time and surface area to absorb heat from the combustion gas to heat water before the water exits the water heater. This is because the temperature of the gas at the inner ring of tubes 212 is much higher than it is at the outer ring of tubes.

Figure 4:
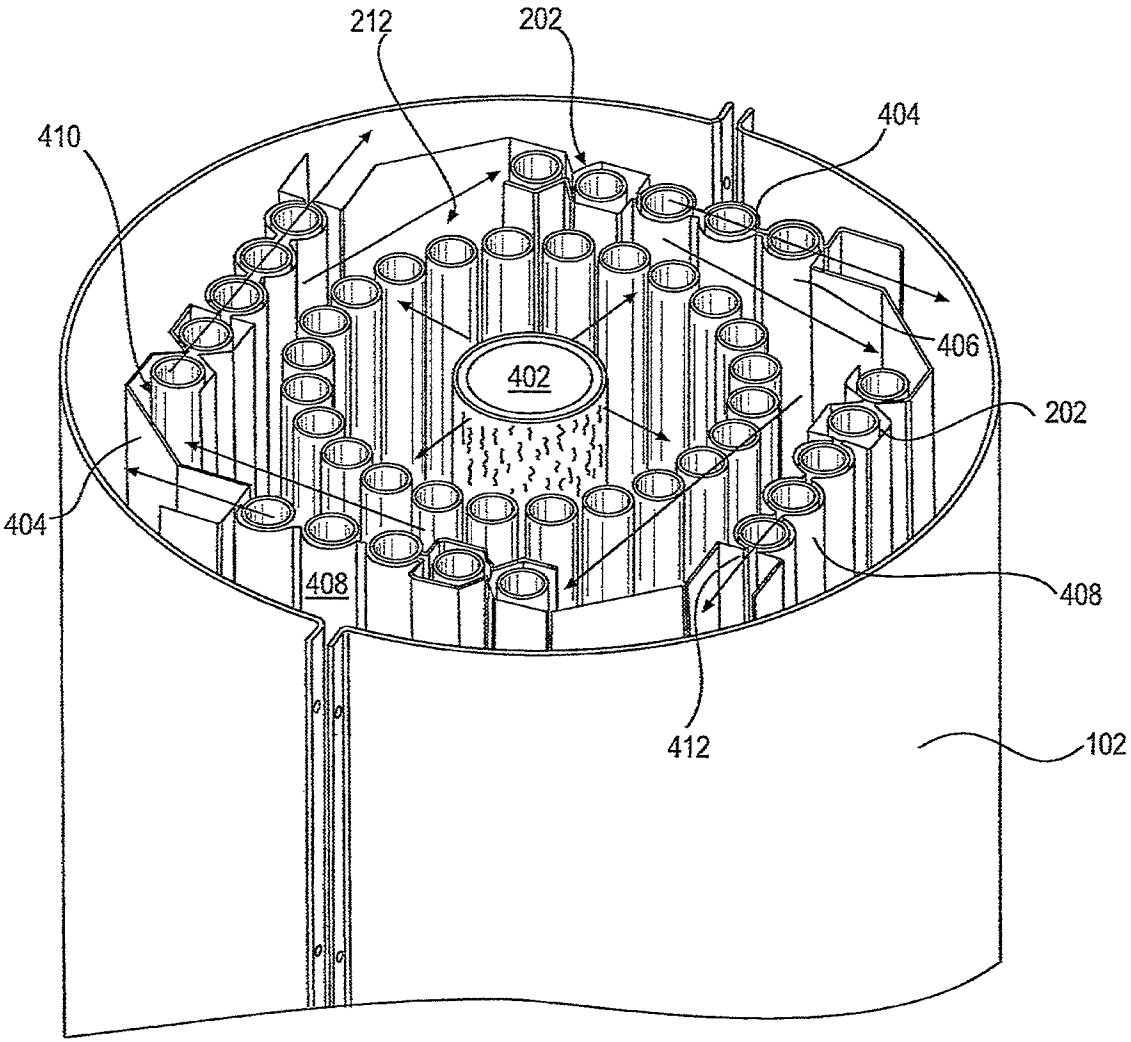
FIG. 4 shows a perspective view of an internal tube, burner and baffle sheet configuration as well as a shell of the heat exchanger of FIG. 1.

Once the combustion gas reaches the outer ring of tubes, some of its energy has been absorbed by the inner ring of tubes 212. So the remaining heat in the combustion gas must be extracted from the combustion gas as efficiently as possible. To do so, the surface area for heat exchange should be increased. Hence, air flow is directed along the series of tubes in parallel to the row of tubes in the outer ring of tubes 202. The fact that the water makes many passes through the tubes effectively increases its dwell time, and therefore surface area, in contact with the combustion gas before the combustion gas finally exits the heat exchanger. As shown in FIG. 4, the outer ring of tubes is preferably transverse to the radial flow of air at the inner ring of tubes. Thus, the radial flow of the combustion gas is redirected into a cross flow. The configuration of the outer ring of tubes 212 helps to reduce the size of the water heater. This configuration along with the addition of baffles greatly increases the efficiency of the water heater.

Figure 3:
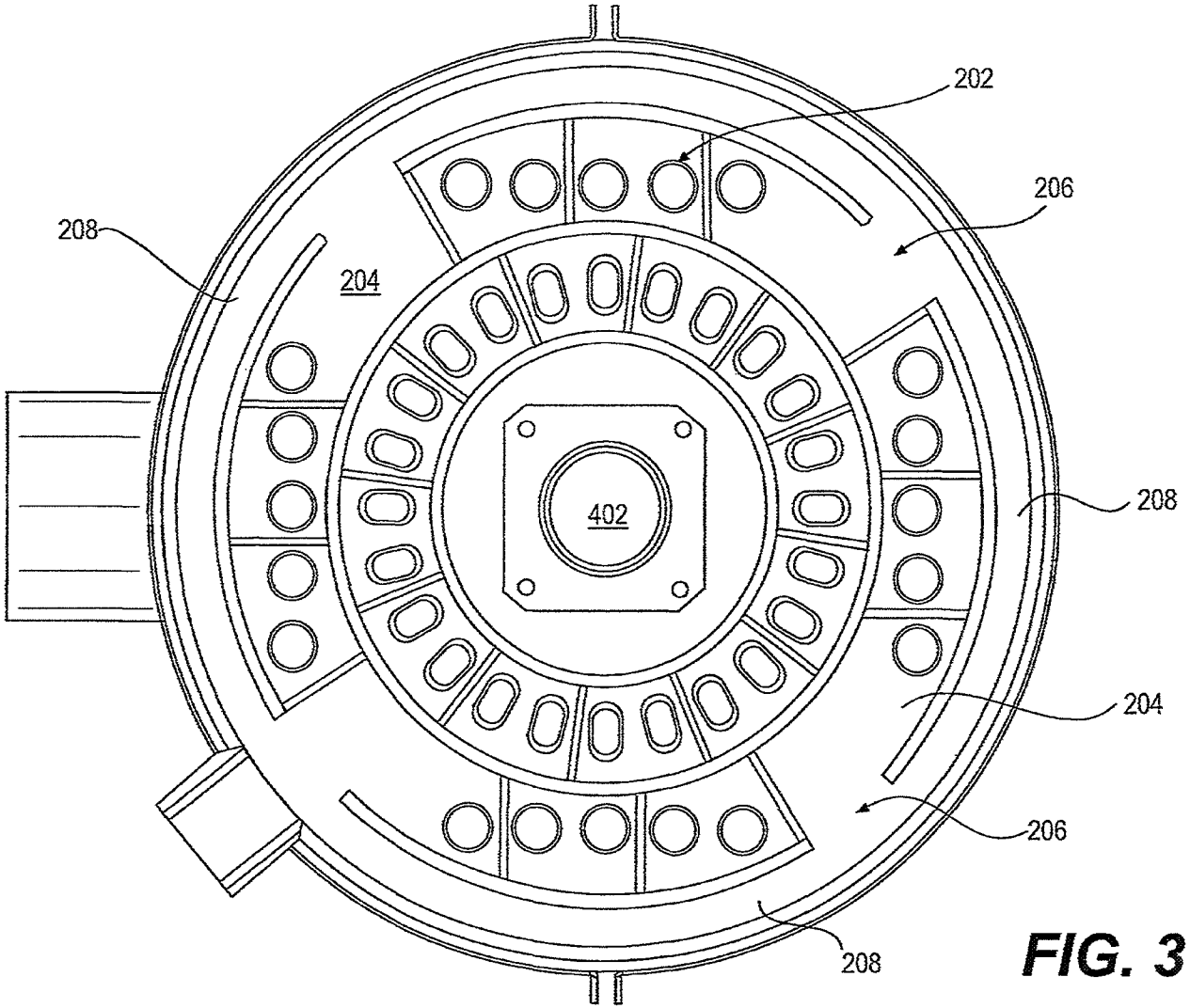
FIG. 3 shows a cross-sectional top view of the upper manifold shown in FIG. 2.

The outer ring of tubes 202 encompasses the inner ring of heat exchange tubes 212. Each tube of the inner ring of tubes outlets to or inlets from a manifold compartment. As shown in the cross section view of FIG. 3, ends of each of the tubes of the inner ring of tubes 212 are oblong or oval whereas ends of each of the tubes of the outer ring of tubes 202 are circular. A high fin tube could be utilized in the inner ring without having an oval end. The embodiment is not limited to this configuration. Round, square, polygonal and any other cross-sectional shape is possible in place of oblong or oval ends. The cross-sectional area on the ends of the tubes is optionally the same as well as along the body of the tube. However, it is possible to flare or compress or otherwise alter the ends of the tubes to make the cross-sectional area of the tube ends larger or smaller, respectively, than the main body of the tube if desired. The ends of any of tubes can be mixed in accordance with a manufacturer's preference. One of the benefits provided by the oblong tube ends is that the inner tubes can be positioned closer together without eliminating access for welding the tubes to a tube sheet. However, tube closeness can also be provided by overlapping or skewing the tubes so that the centers of the tubes when viewed from the tip of the radiator form a zig-zag configuration around the circumference of the water heater. The tubes being closer together reduces the diameter of the inner ring of tubes thereby allowing either a reduction in size of the overall heat exchanger or freedom to configure the outer ring of tubes in any manner desired without enlarging the heat exchanger. As shown in the figures, the outer ring of tubes is in a rectilinear configuration.

FIG. 4 shows an inside of the heat exchanger shell 102. The outer ring of tubes surrounds a burner 402. Baffle sheets 404 are juxtaposed next to the outer ring of heat exchange tubes 202. Each baffle sheet, in cooperation with a neighboring baffle sheet, directs air flow within the heat exchanger 100 in a helical configuration from a center of the shell 102 toward an outer region of the shell 102. Combustion gas and condensate exit the heat exchanger from a single outlet positioned at the lowest point of the heat exchanger. A tee is attached to the outlet and positioned vertically so that gravity drains the condensate into a condensate trap/neutralizer while the combustion gas travels up to a field connected exhaust stack.

Each baffle sheet 404 extends along an entire length of the outer ring of heat exchange tubes 202. Each baffle sheet 404 has an inner section 406 and an outer section 408. The inner section 406 is configured to be positioned on a side of the outer ring of heat exchange tubes 202 that is closer to the center of the heat exchanger while the outer section 408 is configured to be on a side of the outer ring of heat exchanged tubes 202 that is closer to the shell 102. As such, the baffle sheets are interwoven between heat exchange tube sets. The combination of baffle sheets form an air passageway 414 that has an inlet 410 and an outlet 412.

Figure 5:
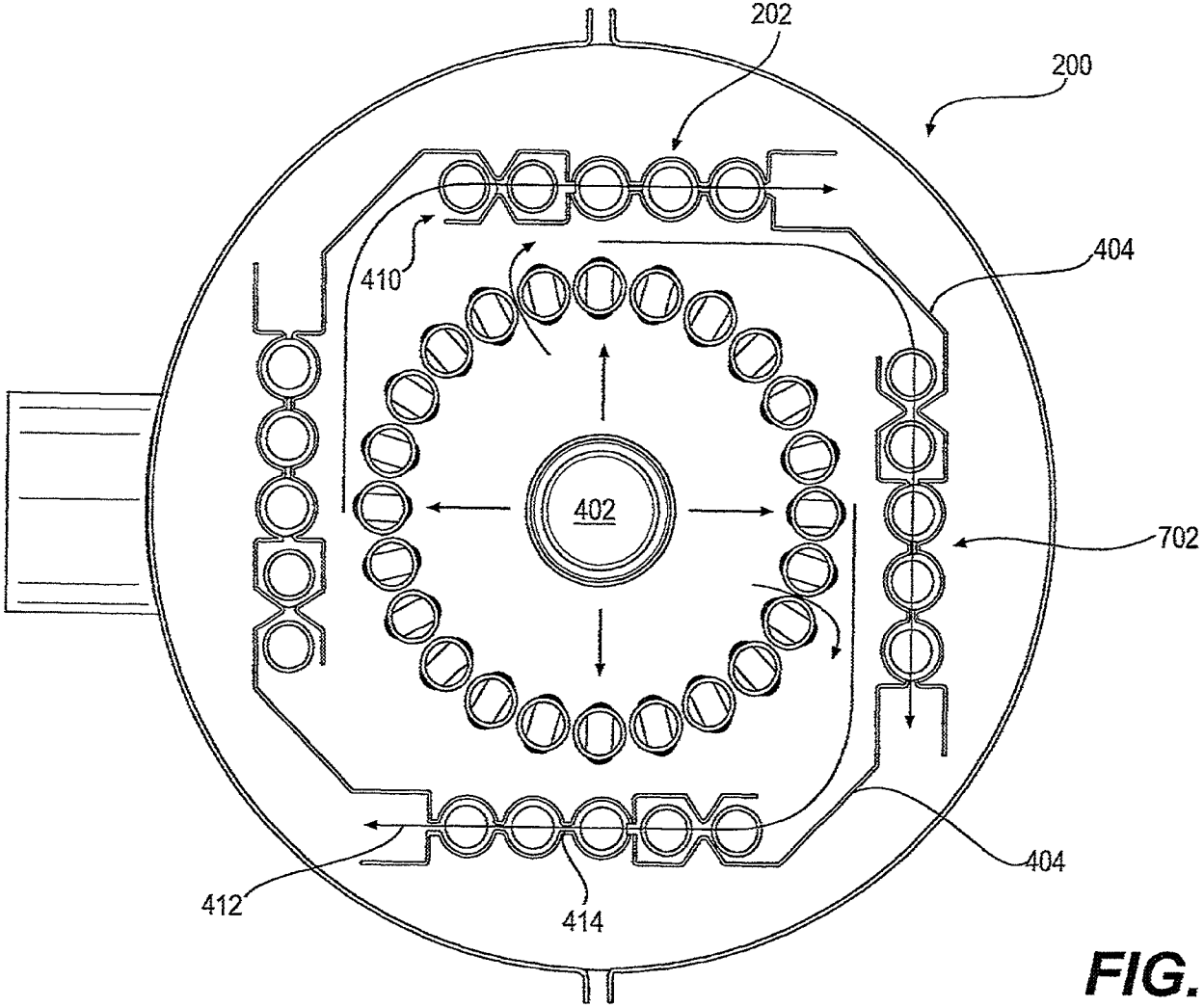
FIG. 5 shows a cross-sectional top view of the internal tube, burner and baffle sheet configuration as well as the shell of the heat exchanger of FIG. 1.

A further embodiment of the heat exchanger is one in which baffles are positioned relative to an outer ring of tubes such that the air flow velocity speeds up as air reaches the outer portion of the heat exchanger. FIG. 5 shows a cross-sectional view of the heat exchanger 100. The inlet 410 is on one end of the outer ring of tubes 202 and the outlet 412 is on an opposite end of the outer ring of tubes 202.

Each baffle is configured in a manner that allows combustion gas to pass quickly along the outer series of tubes 202 near the passageway outlet 412 and slowly at the outer ring of tubes 202 closer to the passageway inlet 410. In this way, optimal heat transfer is advantageously captured at the outer ring of tubes 202. At the inlet 410, the combustion gas will be at its highest temperature. As the combustion gas passes through the passageway 414, combustion gas heat is transferred to the outer ring of tubes 202. As heat is transferred from the combustion gas to the heat exchange tubes of the outer ring of tubes 202, the combustion gas velocity is increased over the last 3 tubes in each water circuit of the economizer section 202 (from the exit (412) being tube 5). To accomplish this, the baffles 404 are closer to the heat exchange tubes at a downstream portion of the passageway 414 than they are at an upstream portion of the passageway 414. By keeping a lower combustion gas velocity in the first two tubes of each economizer circuit (from the entrance (410) being tube 1), the heat transfer into these tubes is reduced, minimizing the risk of hot combustion gasses causing water boiling on the inside of tubes 1 and 2.

The baffles 404 are not limited to what is shown in FIG. 4. Rather, the baffles can be configured as a narrowing passageway, a sinusoidal-like wave wherein the amplitude of the wave grows shorter from inlet toward the outlet, a series of pyramids, rectilinear projections, etc. It may be advantageous to fabricate the baffle 404 from multiple components. If the inside and outside walls of baffle 404 were straight, the corrugations could be made as individual components contained between the tube fins and baffles (404) and achieve the same net result as a single formed baffle. The heat exchange tube sets are sandwiched between each of the baffle sheets. And each tube is aligned with a corresponding projection, i.e., sinusoidal wave, pyramidal projection, rectilinear projection, etc.

Figure 6:
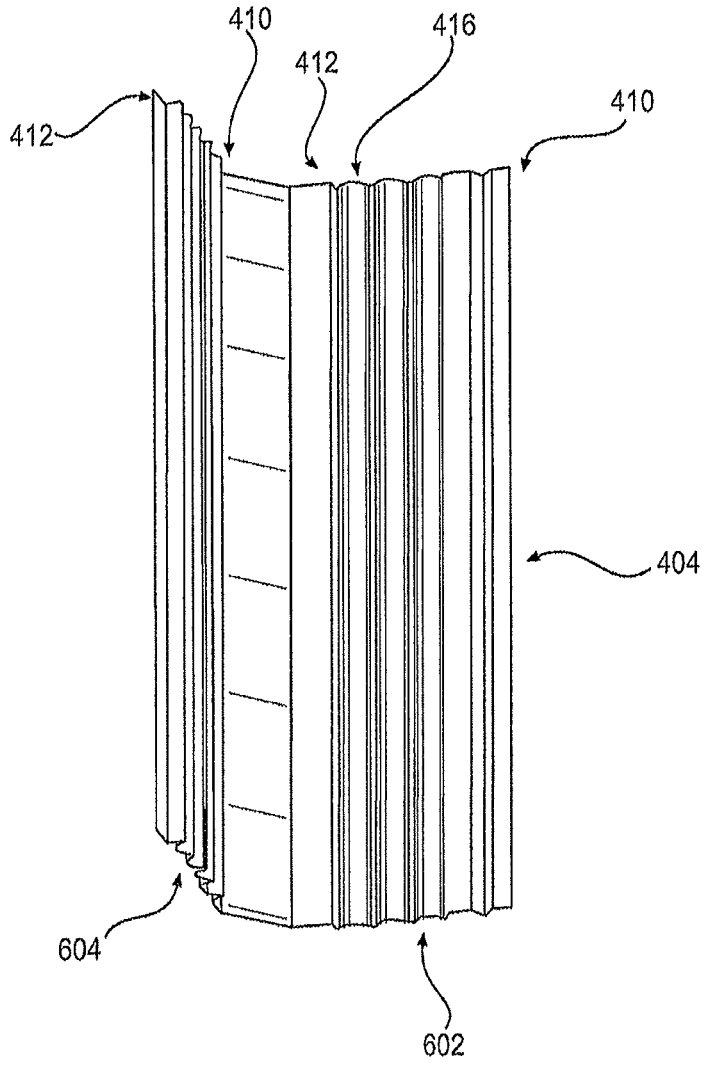
FIG. 6 shows a baffle sheet of the disclosed heat exchanger of FIG. 1.

A baffle sheet 404 is shown more prominently in FIG. 6. As can be seen in FIG. 6, the sinusoidal like wave pattern 416 is more of a half-sinusoidal wave. The baffle sheet is shown as having surfaces that are generally ninety-degrees relative to each other. A first surface of the tube sheet 602 has an edge that is distal to the bend that is the inlet 410 for the passageway 414 and a second surface 604 of the tube sheet has an edge that is distal to the bend that is the outlet 412 of the passageway 414. Each baffle sheet is a part of two tube sets. Therefore, the edge of the first surface 602 of the baffle sheet is an outlet 412 for one of the heat exchange tube sets and the edge of the second surface 604 is the inlet 410 for one of the heat exchange tube sets.

Figure 7:
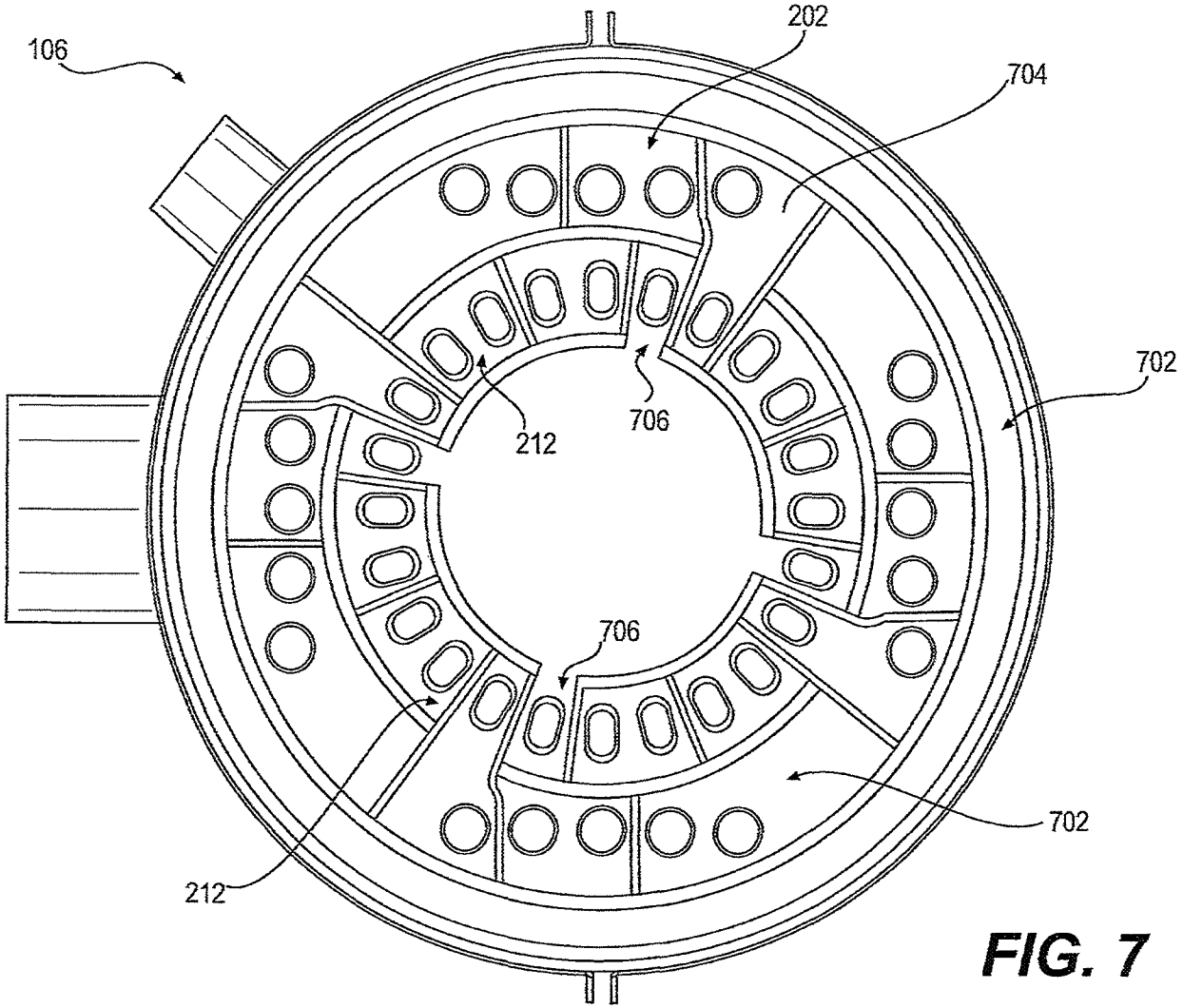
FIG. 7 shows a cross-sectional bottom view of the lower manifold of the disclosed heat exchanger.

A cross section of the lower manifold is shown in FIG. 7. Heat exchange tube sets 702 include tubes from the inner ring of tubes 212 and the outer ring of tubes 202. Water traverses each of the tubes of the outer ring of tubes 202 in a serpentine fashion. An inner-outer ring exchange compartment 704 is present in each tube set 702. Fluid is passed from the outer ring of tubes 202 to the inner ring of tubes 212 at the inner-outer ring exchange compartment 704. When water or any other fluid traversing the heat exchange tubes is in the inner ring of tubes 212, it is near the center of the heat exchanger shell 102, which contains the hottest combustion gas. Therefore, the outer ring of tubes 202 serves as an economizer to preheat fluid traversing the outer ring of tubes. Therefore, as opposed to previous heat exchanger economizer designs, the present heat exchanger includes a compact and highly integrated economizer that reduces material cost and space of the overall unit. The construction of both the upper and lower manifold is shown as welded, but may be designed and tooled for a casting, or may use plastic or sheet metal chamber divider baffles creating waterways then compressed between the tube sheet and a bolt on cover. The manifolds can be entirely cast or they can be made entirely of injection molded plastic. They can also be formed from sheet metal. The water flow path, not construction, is focal to achieving the desired performance.

Each heat exchange tube set 702 includes at least two of the inner series of heat exchange tubes and at least two of the outer series of heat exchange tubes and two baffle sheets. An odd number of tubes is preferred. Six inner tubes are shown in the inner ring of tubes 212 and five outer tubes are shown in the outer ring of tubes 202 in FIG. 7. The odd number of tubes is so that the inlet to the heat exchange tube set is on one end of the heat exchanger and the outlet is on an opposing end of the heat exchanger. However, an even number of tubes is possible when the heat exchanger inlet and outlet are provided on the same end of the heat exchanger.

One continuous tube set is possible. Alternatively, a plurality of tube sets (as shown in FIG. 7) is possible. With one continuous tube set, the outer ring of tubes would extend around the entire periphery of the heat exchanger and one inner-outer ring exchange would be present. This differs from the plurality of tube sets wherein a plurality of inner-outer ring exchanges are present. Further, the inner ring would not necessarily differ in configuration. A plurality of baffle sheets can still separate the tubes to create multiple helical flow patterns. The primary difference with a continuous ring of tubes is that one inlet-outlet compartment is provided in the lower manifold. It is foreseeable that a single baffle sheet could be used for a continuous ring of tubes. In this case, a single passageway would be created around the entire ring. However, efficiency would likely be compromised in such a configuration.

As with the outer ring of tubes 202, water traversing the inner ring of tubes 212 traverses the tubes in a serpentine fashion. Once the fluid reaches the final tube in the inner ring of tubes 212, the water is outlet into a manifold outlet compartment 706.

Figure 8:
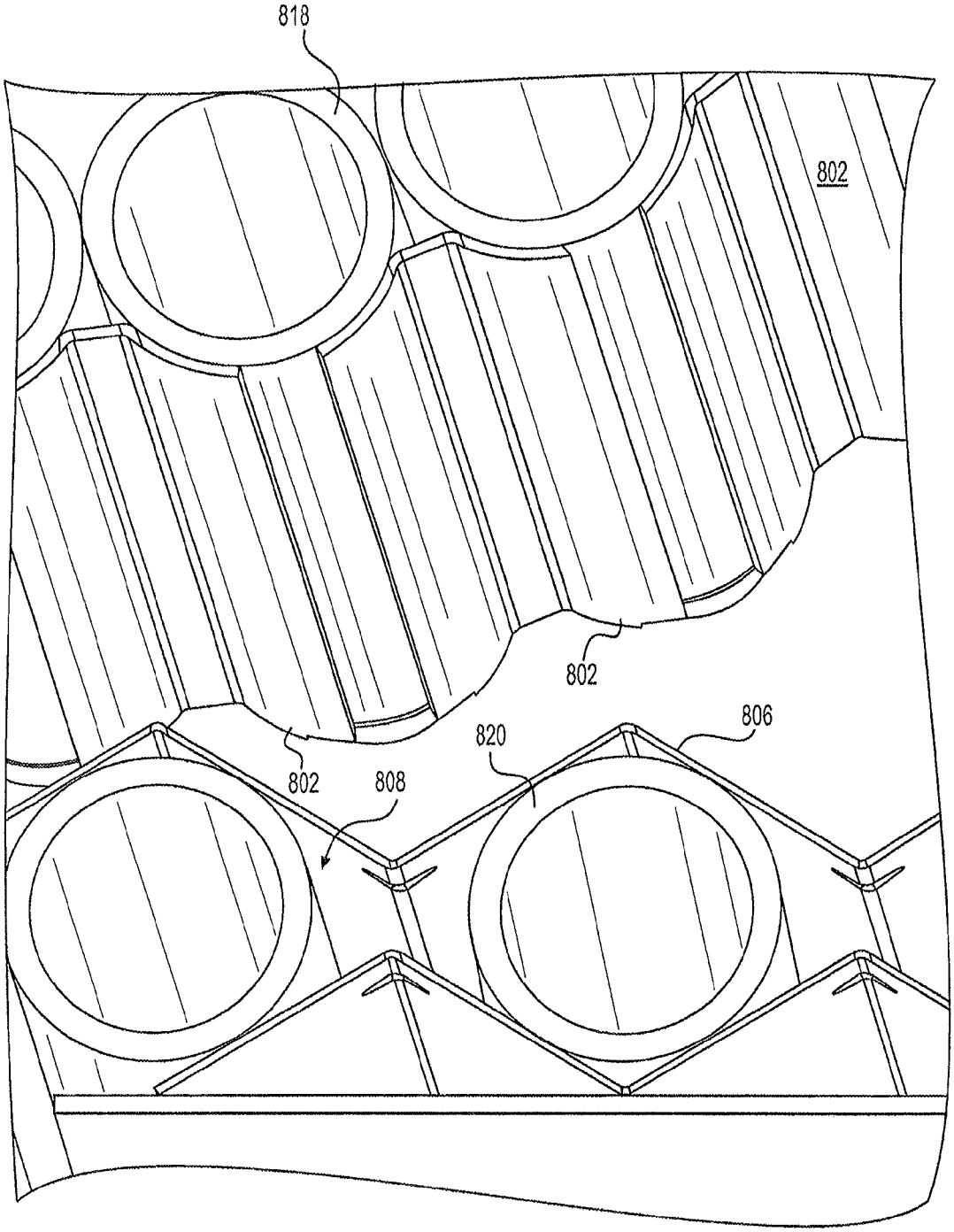
FIG. 8 shows an embodiment of the disclosed heat exchanger having an economizer with a modified tube configuration.
Figure 9:
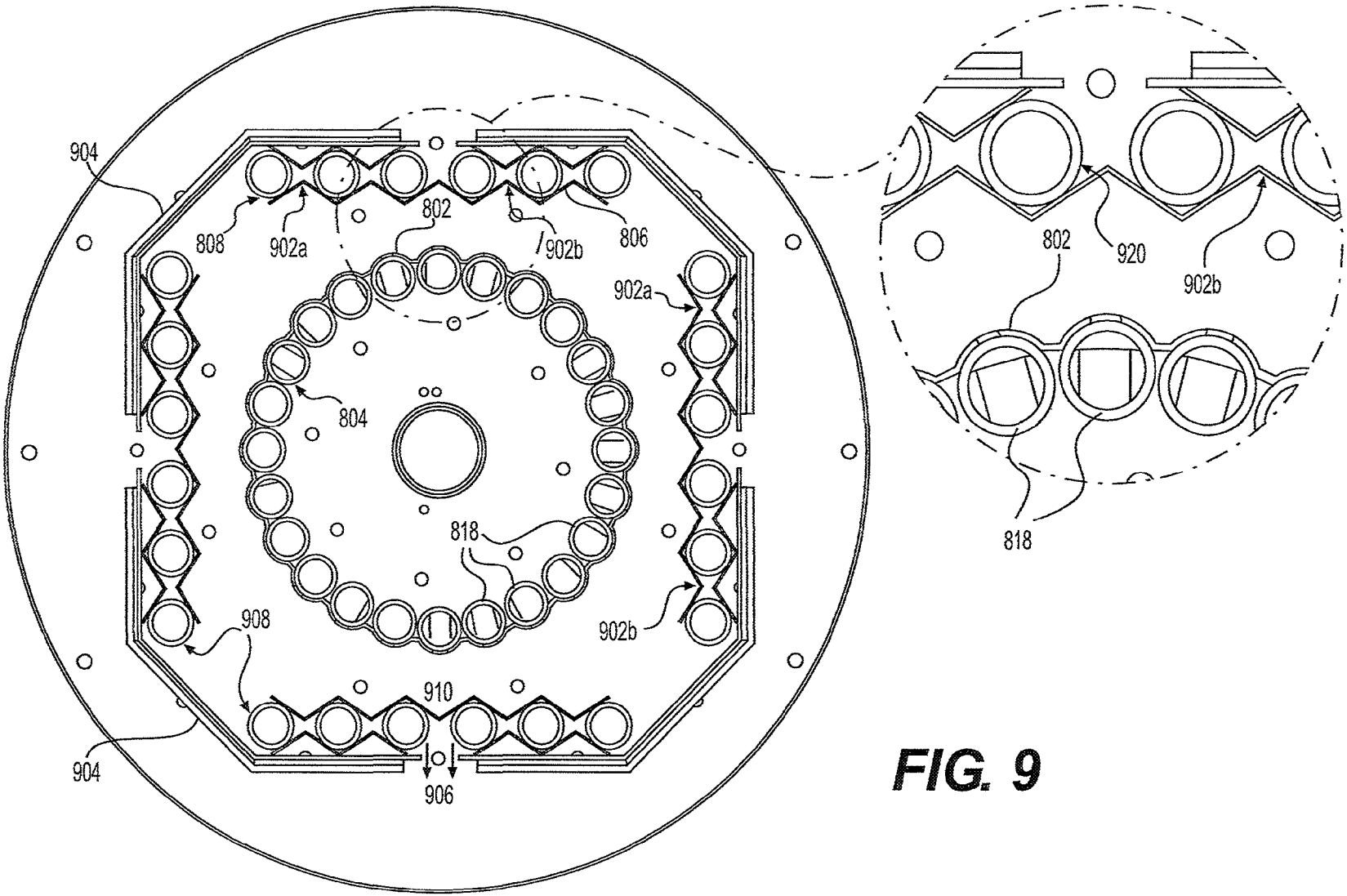
FIG. 9 shows an inner ring of tubes of the embodiment shown in FIG. 8.

In a yet further embodiment, as shown in FIGS. 8 and 9, baffles 802 can be added so that they encompass an inner ring 804 of tubes 818. These baffles are not necessarily limited to the corrugated type shown in FIGS. 4-6 and described herein. The baffles can be corrugated, planar, arcuate or any other desirable shape. As shown in FIG. 8, the baffles 802 are corrugated and configured with a cross-section that corresponds with each of the tubes 818 of the inner ring 804 of tubes. The tubes 818 are circular and the baffles 802 have circular sections as well. Thus, the distance between each baffle 802 and each tube 818 is uniform. The purpose of the baffles 802 at the inner ring 804 of tubes 818 is to help improve heat transfer between the water in the tubes 818 of the inner ring 804 and the combustion gas.

With respect to fluid flow of the combustion gas through the economizer, in this embodiment, the baffles 806 for outer ring 808 of tubes 820 are positioned proximate to and equidistant from the tubes 820 along the entire length of each section of the outer ring of tubes. Therefore, fluid flow remains constant along the tubes of the economizer. This ensures constant velocity along the tubes from the inlet to the outlet of the baffle sheets. Such a configuration makes condensation on the exterior of the inner and outer tubes easier to control.

The configuration of the inner ring 804 of tubes includes four sets of three-and-three outer groups of tubes 902*a* and 902*b*. There are three tubes in the group of tubes 902*a* and there are three tubes in the group of tubes 902*b*. Both groups make up a set of "three-and-three." Flow of combustion gas enters the outer portion of the water heater and is redirected toward the outer ring 808 of tubes by exterior baffles 904. Combustion gas exits the three-and-three tube sets 902*a* and 902*b* through outlets 906 and generally follows the direction of the arrows 908 and 910.

As with earlier embodiments, as combustion gas passes the inner ring 804 of tubes, it flows radially outward. This radial flow of the combustion gas provides the inner ring 804 of tubes enough time and surface area to absorb heat from the combustion gas to heat water before the water exits the water heater. This is because the temperature of the gas at the inner ring 804 of tubes is much higher than it is at the outer ring 808 of tubes.

Once the combustion gas reaches the outer ring 808 of tubes, some of its energy has been absorbed by the inner ring 804 of tubes. So the remaining heat in the combustion gas must be extracted from the combustion gas as efficiently as possible. To do so, the surface area for heat exchange should be increased. Hence, air flow is directed along the series of tubes of the outer ring 808 of tubes in parallel to the row of tubes in the outer ring 808 of tubes. The fact that the water makes many passes through the tubes effectively increases its time, and therefore surface area, in contact with the combustion gas before the combustion gas finally exits the heat exchanger. As shown in FIG. 9, the outer ring 808 of tubes is transverse to the radial flow of air at the inner ring of tubes. Thus, the radial flow of the combustion gas is redirected into a cross flow. The configuration of the outer ring 808 of tubes helps to reduce the size of the water heater. This configuration along with the addition of baffles greatly increases the efficiency of the water heater.

This embodiment uses a slightly different manifold than that shown in the previous embodiments. The upper and lower manifolds are designed so that the inlets and outlets of the manifold mate with the inlets and outlets of the tubes. A three-and-three inlet and outlet is provided in the manifold of the present embodiment. Water circulates through the tubes in a serpentine fashion and passes from the outer ring 808 of tubes 820 to the inner ring 804 of tubes 818. However, the number of passes would differ from earlier embodiments. Also, the water inlets of the groups of tubes 902*a* and 902*b* are positioned at the interior 910 of the groups of tubes 902*a* and 902*b*. Water traverses up and down the tube sets being redirected through the tubes by the manifolds. The water exits from the outer ring 808 of tubes into the interior ring 804 of tubes at the tube closest to the inlet of the exterior baffles 904. The chambers of the manifolds of this embodiment differ from the earlier embodiments to account for six tubes per set 902*a* and 902*b* as opposed to five tubes in earlier embodiments.

It will be understood that many additional changes in the details, materials, steps and arrangement of parts, which have been herein described and illustrated to explain the nature of the invention, may be made by those skilled in the art within the principal and scope of the invention as expressed in the appended claims.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

I claim:

1. A heat exchanger configured for transferring heat from combustion gases from a burner to water contained in heat exchange tubes, the heat exchanger comprising:

an inner series of heat exchange tubes arranged to surround the burner such that combustion gases emanating from the burner flow radially through spaces defined between adjacent heat exchange tubes of the inner series;

an outer series of heat exchange tubes spaced outwardly from the heat exchange tubes of the inner series;

a first baffle juxtaposed adjacent the heat exchange tubes of the outer series, the first baffle being positioned to direct the flow of combustion gases adjacent the heat exchange tubes of the outer series, a second baffle juxtaposed adjacent the heat exchange tubas of the outer series and opposed the first baffle, the first baffle and the second baffle together defining an air passageway that converts air flow inside the heat exchange from radial flow to helical flow; and a shell enclosing the heat exchange tubes of the inner and outer series.

2. The heat exchanger as recited in claim 1 wherein the outer series of tubes comprises a plurality of tubes arranged parallel to each other in a linear row.

3. The heat exchanger as recited in claim 2 wherein the inner series of tubes comprises a plurality of tubes arranged parallel to each other in an arcuate row.

4. The heat exchanger as recited in claim 1 wherein the inner series of tubes comprises tubes having a circular cross section along a main body of each tube and an oblong cross section at each end of the tube.

5. The heat exchanger as recited in claim 1 wherein at least one of the first baffle or the second baffle extends along an entire length of a set of the outer series of heat exchange tubes.

6. The heat exchanger as recited in claim 1 further comprising a plurality of subsystems, wherein each subsystem comprises at least two of the inner series of heat exchange tubes and at least two of the outer series of heat exchange tubes and two baffle sheets.

7. The heat exchanger as recited in claim 6 further comprising an access passageway along a circumference of the shell and in communication with the plurality of subsystems.

8. The heat exchanger as recited in claim 7 wherein each subsystem further comprises an entry port coupling the access passageway to a manifold compartment.

9. The heat exchanger as recited in claim 1 wherein airflow velocity at an upstream portion of the air passageway is equal to airflow velocity at a downstream portion of the air passageway.

10. The heat exchanger as recited in claim 9 wherein one of the first baffle or the second baffle comprises a series of baffles and each baffle of the series of baffles comprises a plurality of differently shaped corrugations.

11. The heat exchanger as recited in claim 10 wherein the outer series of heat exchange tubes are sandwiched between each of the corrugations.

12. The heat exchanger as recited in claim 11 wherein each baffle is a sheet extending along an entire length of the tubes and along an entire width of the plurality of tubes.

13. The heat exchanger as recited in claim 1 wherein the inner series of heat exchanger tubes are configured to form an arcuate arrangement and the outer series of tubes are configured to form a linear arrangement proximate to the inner series of tubes.

14. The heat exchanger of claim 1 wherein the outer series of heat exchanger tubes are spaced radially outwardly from the inner series of heat exchanger tubes.

15. The heat exchanger of claim 1, the first baffle directing combustion gas flow between the outer series of tubes and the inner series of tubes in a helical configuration.

16. The heat exchanger of claim 1, wherein an airflow velocity at an upstream portion of the air passageway is lower than an air flow velocity at a downstream portion of the air flow passageway.

17. A heat exchanger comprising:

an inner series of heat exchange tubes arranged to surround a burner such that combustion gases emanating from the burner flow radially through spaces defined between adjacent heat exchange tubes of the inner series;

an outer series of heat exchange tubes spaced outwardly from the heat exchange tubes of the inner series, wherein adjacent tubes of the outer series of tubes are arranged parallel to each other and in a linear row, such that each of the adjacent tubes of the outer series of tubes is arranged to be in a linear row;

at least a first baffle juxtaposed adjacent the heat exchange tubes of the outer series, the first baffle being positioned to direct the flow of combustion gases adjacent the heat exchange tubes of the outer series; and a shell enclosing the heat exchange tubes of the inner and outer series.

18. The heat exchanger of claim 17, further comprising at least a second baffle juxtaposed adjacent the heat exchanger tubes of the outer series and opposed the first baffle, the first baffle and the second baffle together defining an air passageway configured to redirect the flow of combustion gases from a generally radial direction to a generally circumferential direction within the heat exchange.

19. A heat exchanger comprising:

an inner series of heat exchange tubes arranged to surround the burner such that combustion gases emanating from the burner flow radially through spaces defined between adjacent heat exchange tubes of the inner series, wherein the inner series of heat exchange tubes are configured to form an arcuate arrangement;

an outer series of heat exchange tubes spaced outwardly from the heat exchange tubes of the inner series, wherein adjacent tubes of the outer series of heat exchange tubes are configured to form a linear arrangement with adjacent tubes of the outer series of tubes and to be proximate to the inner series of heat exchange tubes;

at least a first baffle juxtaposed adjacent the heat exchange tubes of the outer series, the first baffle being positioned to direct the flow of combustion gases adjacent the heat exchange tubes of the outer series; and a shell enclosing the heat exchange tubes of the inner and outer series.

20. The heat exchanger of claim 19, further comprising a second baffle juxtaposed adjacent the heat exchange tubes of the outer series and opposed the first baffle, the first baffle and the second baffle together defining an air passageway, wherein an airflow velocity at an upstream portion of the air passageway is lower than an air flow velocity at a downstream portion of the air flow passageway.

21. The heat exchanger of claim 19, wherein the linear arrangement of the outer series of tubes comprises a plurality of tubes arranged parallel to each other in a linear row.

22. The heat exchanger of claim 19 further comprising a second baffle, wherein the first baffle and the second baffle together convert air flow inside the heat exchanger from radial flow to helical flow and directs airflow in a direction parallel to a set of tubes in the outer series of heat exchange tubes.

23. The heat exchanger of claim 19 wherein at least one heat exchange tube of the inner series of heat exchange tubes comprises an end portion having an oblong cross section relative to a cross section of a remainder of the tube.

24. A heat exchanger comprising:

an inner series of heat exchange tubes arranged to surround the burner such that combustion gases emanating from the burner flow radially through spaces defined between adjacent heat exchange tubes of the inner series;

an outer series of heat exchange tubes spaced outwardly from the heat exchange tubes of the inner series;

a first baffle juxtaposed adjacent the heat exchange tubes of the outer series, the first baffle being positioned to direct the flow of combustion gases adjacent the heat exchange tubes of the outer series, a second baffle juxtaposed adjacent the heat exchange tubes of the outer series and opposed the first baffle, the first baffle and the second baffle together defining an air passageway, wherein an airflow velocity at an upstream portion of the air passageway is lower than an air flow velocity at a downstream portion of the air flow passageway; and a shell enclosing the heat exchange tubes of the inner and outer series.

25. The heat exchanger of claim 24 wherein the outer series of tubes comprises a plurality of tubes arranged parallel to each other in a linear row.

26. The heat exchanger of claim 24, wherein air passageway defined by the first baffle and the second baffle redirects air flow inside the heat exchanger from radial flow to helical flow.

* * * * *